US009889360B1

(12) United States Patent
Wilson

(10) Patent No.: US 9,889,360 B1
(45) Date of Patent: Feb. 13, 2018

(54) BASEBALL SWING TRAINING APPARATUS

(71) Applicant: Orville Richard Wilson, Katy, TX (US)

(72) Inventor: Orville Richard Wilson, Katy, TX (US)

( * ) Notice: Subject to any disclaimer, the term of this patent is extended or adjusted under 35 U.S.C. 154(b) by 0 days.

(21) Appl. No.: 15/146,889

(22) Filed: May 4, 2016

Related U.S. Application Data

(60) Provisional application No. 62/156,760, filed on May 4, 2015.

(51) Int. Cl.
*A63B 69/00* (2006.01)

(52) U.S. Cl.
CPC ..... *A63B 69/0084* (2013.01); *A63B 69/00* (2013.01); *A63B 69/0002* (2013.01); *A63B 69/0073* (2013.01); *A63B 69/0079* (2013.01); *A63B 2069/0008* (2013.01)

(58) Field of Classification Search
CPC ..... A63B 69/0084; A63B 69/0024
USPC ..... 473/426, 428, 422, 139, 142, 147; 273/406, 369, 359, 370
See application file for complete search history.

(56) References Cited

U.S. PATENT DOCUMENTS 495,371 A * 4/1893 Rice ..... F41J 9/02 273/369
650,008 A * 5/1900 Hamel ..... F41J 9/02 273/359
3,469,840 A * 9/1969 Kruzel ..... A63B 69/0084 473/428
3,471,153 A * 10/1969 Baumler ..... F41J 9/02 273/359
3,630,521 A * 12/1971 Lingbeek ..... A63B 69/0084 473/426
4,138,107 A * 2/1979 Janis ..... A63B 69/0084 473/426
4,601,261 A * 7/1986 Genelin ..... A01K 15/027 119/839
4,944,513 A * 7/1990 Zentner ..... A63B 69/0084 473/428
5,688,196 A * 11/1997 O'Neil ..... A63B 63/06 473/439
6,821,216 B1 * 11/2004 Van Asselt ..... A63B 69/0024 473/422
7,014,577 B2 * 3/2006 Van Asselt ..... A63B 69/0084 473/422
7,134,975 B1 11/2006 Van Asselt
8,074,994 B1 * 12/2011 Delphia ..... F41J 3/00 273/406

* cited by examiner

*Primary Examiner* — Mitra Aryanpour
(74) *Attorney, Agent, or Firm* — Kenneth A. Roddy

(57) ABSTRACT

A swing training apparatus for baseball or softball that suspends or propels a tethered ball to be hit by a batter. The apparatus includes two elongated vertically spaced apart cords disposed, one above the other, connected at opposed ends to vertical upright members to extend therebetween relative to a horizontal axis in a taut tightly stretched or drawn condition. One or both cords may be formed of elastic material and may extend between the uprights generally parallel to, or slightly angularly relative to, the horizontal axis. A ball trolley with a practice ball is movably supported vertically between the two elongate cords. The ball trolley includes two pulleys, each mounted on a respective elongate cord in vertically opposed relation, and a practice ball is captured between and attached to the pulleys.

4 Claims, 5 Drawing Sheets

BASEBALL SWING TRAINING APPARATUS

CROSS REFERENCE TO RELATED APPLICATION

This application claims priority of U.S. Provisional Application Ser. No. 62/156,760, filed May 4, 2015.

BACKGROUND OF THE INVENTION

1. Field of the Invention

This invention relates generally to baseball or softball practice and training apparatus for improving batting skills, and more particularly to a swing training apparatus for baseball or softball that utilizes a ball which is suspended to travel to back or forth, between two vertically spaced apart lines that are generally horizontally oriented.

2. Background Art

As used herein, the terms "elastic" and "resilient" mean capable of returning to its original shape after compression, expansion, stretching, or other deformation. The terms "inelastic" and "non-elastic" mean incapable of compression, expansion, stretching, or other deformation. The terms "rigid" and "rigidly" means of or pertaining to a body in which the distance between any pair of points remains fixed under all forces; stiff; unyielding; not pliant.

There are several patents directed toward training apparatus that utilize a ball which is suspended between two vertically spaced apart members by various means to travel to back or forth between two vertically spaced generally horizontally oriented members. The following are several examples.

Lingbeek, et al., U.S. Pat. No. 3,630,521, discloses a baseball batting practice device which includes a ball mounted in a position to be struck by a batter. The ball is slidably disposed on a short vertical elastic cord. Each end of the elastic cord is provided with a ring. The top ring is slidably disposed on an upper horizontal wire stretched between two vertical posts. The bottom ring is slidably disposed on a lower wire which is parallel to the upper one. The vertical elastic cord has a stop tube, spring, or other springy material mounted thereon in a position on the elastic cord to limit downward sliding of the ball. A grommet fitted inside the ball is of sufficient inside diameter to allow the ball to freely slide up and down on the elastic cord between the top of the stop tube and the bottom of the top ring.

Janis, U.S. Pat. No. 4,138,107 discloses a sports practice device for practicing the stroking motion used in games such as tennis, baseball, squash and the like, which includes a pair of guide rails mounted to the floor and ceiling of a room, a pair of carriages which ride in the rails and travel between stops mounted in the rails, and a ball secured to an elastic cord which in turn is secured to the carriage members and suspends the ball a pre-determined distance above the floor at a hitting position. When the ball is hit, motion is imparted to the carriage members which move along the guide rails until their motion is stopped by the stops. The ball continues to move stretching the elastic cord which after full stretch snaps the ball back to its initial position.

The Janis (U.S. Pat. No. 4,138,107) and Lingbeek, et al., (U.S. Pat. No. 4,138,107) apparatus do not control the location where the ball settles or stops after being hit; and thus, the ball, absent force, might come to rest anywhere along the length of the vertically spaced horizontal wires or rails.

Van Asselt, U.S. Pat. No. 6,821,216, discloses an apparatus for use in playing and practicing ball games which includes a ball suspended by a substantially inelastic upstanding reciprocating line from an upper, generally horizontal or inclined elongated guideway and connected by the same or a second substantially inelastic upstanding reciprocating line to a lower, generally horizontal or inclined elongated guideway. The lower guideway may be at ground level and the height of the ball above the ground may be adjustable. The upper and lower guideways are formed of plastics coated cord, and the upper and lower inelastic reciprocating lines connected with the ball are supported from the upper guideway and connect to the lower guideway by a loop or ring.

Van Asselt, U.S. Pat. No. 7,014,577, discloses an apparatus for improving the skills of a sports person which comprises two diverging guidelines at least one of which is resilient and tensioned. A non-elastic reciprocating line extends between and is connected to each guideline whose length is equal to or greater than the minimum spacing of the guidelines and less than the maximum spacing of the guidelines. A ball is connected to and generally coaxial with the reciprocating line, the arrangement being such that when the ball is struck the reciprocating line is moved by its connection with the ball along the guidelines in the direction of their divergence until restrained from further movement by forces imposed on the line caused by the increased spacing between the guidelines and stretching of the resilient guideline(s). The ball and reciprocating line are returned to their starting positions (or positions close thereto) along the guidelines in the direction of their convergence through reactive forces generated between the reciprocating line and the resilient guideline(s). The reciprocating line is connected to the guidelines through a slide which comprises a hinged clip, ring, rope slide or adjustable loop.

Van Asselt, U.S. Pat. No. 7,134,975, discloses an apparatus for practicing the technique of lofting a ball, the apparatus having a support frame containing two upright supports linked by a horizontal cross-bar. Two inclined guideways extend between ground anchors and the supports. A substantially inelastic reciprocating device is connected to and freely movable along the guideways and a ball connected to the reciprocating device. The guideways and the reciprocating line are made of a low friction material such as a plastic-covered cord or wire, and the reciprocating line is connected to the guideways through a slide which comprises a hinged clip, ring, rope slide or adjustable loop.

The apparatus of the Van Asselt patents return the ball to or near its original location after it has been hit. However, they are not particularly suitable for use in a baseball or softball swing training situation, due to the fact that they secure the ball to a "reciprocating" line, which is slidably connected at each end to guidelines, where the length of the "reciprocating" line is equal to or greater than the minimum spacing between the guidelines along their length.

SUMMARY OF THE INVENTION

The present invention overcomes the aforementioned problems, and is distinguished over the prior art in general, and these patents in particular by a swing training apparatus for baseball or softball that suspends or propels a tethered ball to be hit by a batter. The apparatus includes two elongated vertically spaced apart cords disposed, one above the other, connected at opposed ends to vertical upright members to extend therebetween relative to a horizontal axis in a taut tightly stretched or drawn condition. One or both cords may be formed of elastic material and may extend between the uprights generally parallel to, or slightly angularly relative to, the horizontal axis.

A ball trolley with a practice ball is movably supported vertically between the two elongate cords. The ball trolley includes two pulleys, each mounted on a respective elongate cord in vertically opposed relation, and a practice ball is captured between and attached to the pulleys. In one embodiment, the practice ball may be a solid polyurethane dimpled pitching machine ball. A hole is bored through the center of the practice ball, and an inelastic cord extending through the hole is tied or otherwise secured at one end to the top pulley, the inelastic cord has a knot tied below the ball to serve as a stop and the opposed end of the inelastic cord beneath the knot is tied or otherwise secured to the bottom pulley.

The swing training apparatus allows the ball trolley, when force is applied, to roll back and forth along and between the elongate cords and then, absent force, roll to and stop at a point of least resistance between the vertical uprights. The present apparatus allows the spacing between the elongate cords to be limited based on the distance between the two pulleys. It allows the length of the elongate cords to be adapted to the spacing between the vertical uprights. It permits the elongate cords to be oriented level or somewhat inclining or declining relative to a horizontal axis. The present apparatus also allows the spacing between the upper and lower elongate cords at the end points to be adjusted or changed, thereby causing the ball trolley to roll and settle near the center or nearer one end or the other end of the elongate cords, regardless of the general inclination of the two cords.

One of the significant differences and advantages of the present invention is that the practice ball is tethered such that a batter may hit the ball and the ball will be confined to a limited space.

Another significant difference and advantage of the present invention is that a batter can only hit the ball, without interference of the upper and lower elongate cords, by swinging the bat between and with the same inclination of the two elongate cords.

Another significant difference and advantage of the present invention is that the ball can be held stationary between the elongate cords for the batter to hit, or a second person may retract the ball toward one end of the cords and release it for a batter, positioned toward the opposite end of the cords, to hit while the ball is in motion.

Another significant difference and advantage of the present invention is that a swing of the bat that hits the ball squarely in the direction of the elongate cords causes the ball trolley to roll some distance along the length of the cords, offering visual feedback to the batter.

Another significant difference and advantage of the present invention is that a swing which strikes either of the elongate cords or does not drive the ball along the direction of the cords also offers feedback due to the erratic or unpredictable movement of the ball trolley.

Another significant difference and advantage of the present invention is that when practicing alone, the elastic forces in the elongate cord(s) will tend to return the ball trolley to its original stationary position after the ball is hit, and when practicing with a second person the spacing between the upper and lower elongate cords at the end point(s) can be varied to move the ball trolley back and forth along the cords.

Other differences and advantages of the invention will become apparent from time to time throughout the specification and claims as hereinafter related.

DESCRIPTION OF THE PREFERRED EMBODIMENT

Figure 1:
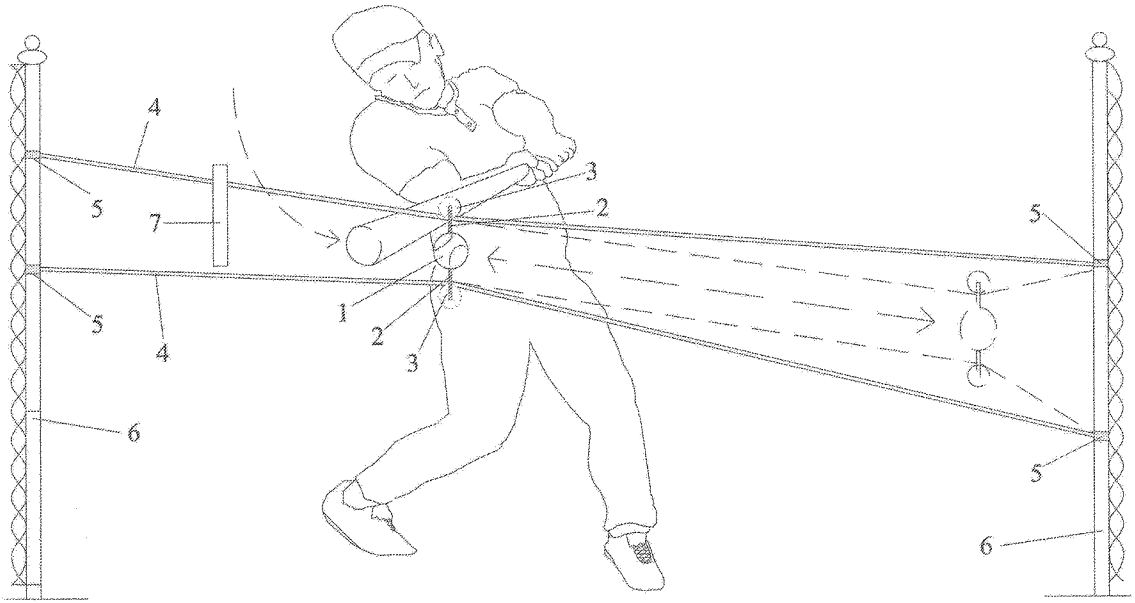
FIG. 1 is a side elevation of the swing training apparatus in accordance with the present invention, showing a batter swinging a bat between the two elongate cords to strike the ball.

Referring to the drawings by numerals of reference, there is shown in FIG. 1, a ball trolley which includes a practice ball 1 captured on an inelastic line 2 connected at each end to pulleys 3. The pulleys are separately mounted on elongate upper and lower cords 4 which, according to this embodiment, are both stretchable elastic cords. The ends 5 of the elongate cords 4 are attached to two spaced apart vertical uprights 6 whereby one cord is positioned above the other, both cords 4 are tensioned horizontally between the uprights and the ball trolley is tensioned vertically between the upper and lower cords. As shown in FIG. 1, the vertical spacing of the elongate cords 4 at both of their opposed ends where connected to the vertical uprights 6 is greater than the fixed length of the inelastic lines 2 of the ball trolley such that the ball trolley is tensioned between the elongate cords 4, and the elongate cords are spanned-out and diverge in opposed directions from the point at which the ball trolley sheaves are supported to the points of connection of both of their opposed ends to the vertical upright members, respectively.

In FIG. 1, the cords are attached to two post such as a wide gate opening in a chain link fence and decline downward in relation to the direction of a batter's swing. The cords are also attached in a manner where the elastic forces in the cords cause the ball trolley to settle somewhat toward the higher end of the cords. There, a batter, hitting left-handed or right handed, can swing a bat between the two elastic cords and strike the ball. When the swing of the bat misses both the upper and lower cords and drives the ball in the direction of the cords, the ball will shoot along between the elastic cords, the tension on the cords and ball trolley will increase due to the increased spacing between the cords, and, as shown in dashed lines, the ball will stop and then rebound back to approximately its original position where the exercise can be repeated if the batter so desires. If the swing of the bat strikes one of the cords or, upon striking the ball, does not drive the trolley in the direction of the cords, the reaction of the ball trolley will be unpredictable or erratic, evidencing an incorrect swing according to the set-up of the device. As shown, the mechanism coaches a fundamentally sound swing; a proper bat path to the ball and correct angle of the bat head at the point of contact.

An optional element that would adjustably attach to at least one of the cords, a swing compaction member 7, may be utilized with the invention. The object of this element would be instructive, to train batters to develop a short, compact swing. In use, it would be positioned behind the batter, blocking the opening between the cords, at a point where it would be hit by the bat if the swing begins with an extension of the arms and bat instead of with a rotation of the hips and torso. Made of foam, fabric or other material that is flexible and resilient, this piece would be constructed such that it would not prevent or interrupt a batters swing but nonetheless be felt or hear by the batter if it were hit by the bat on its way to the ball.

Figure 2:
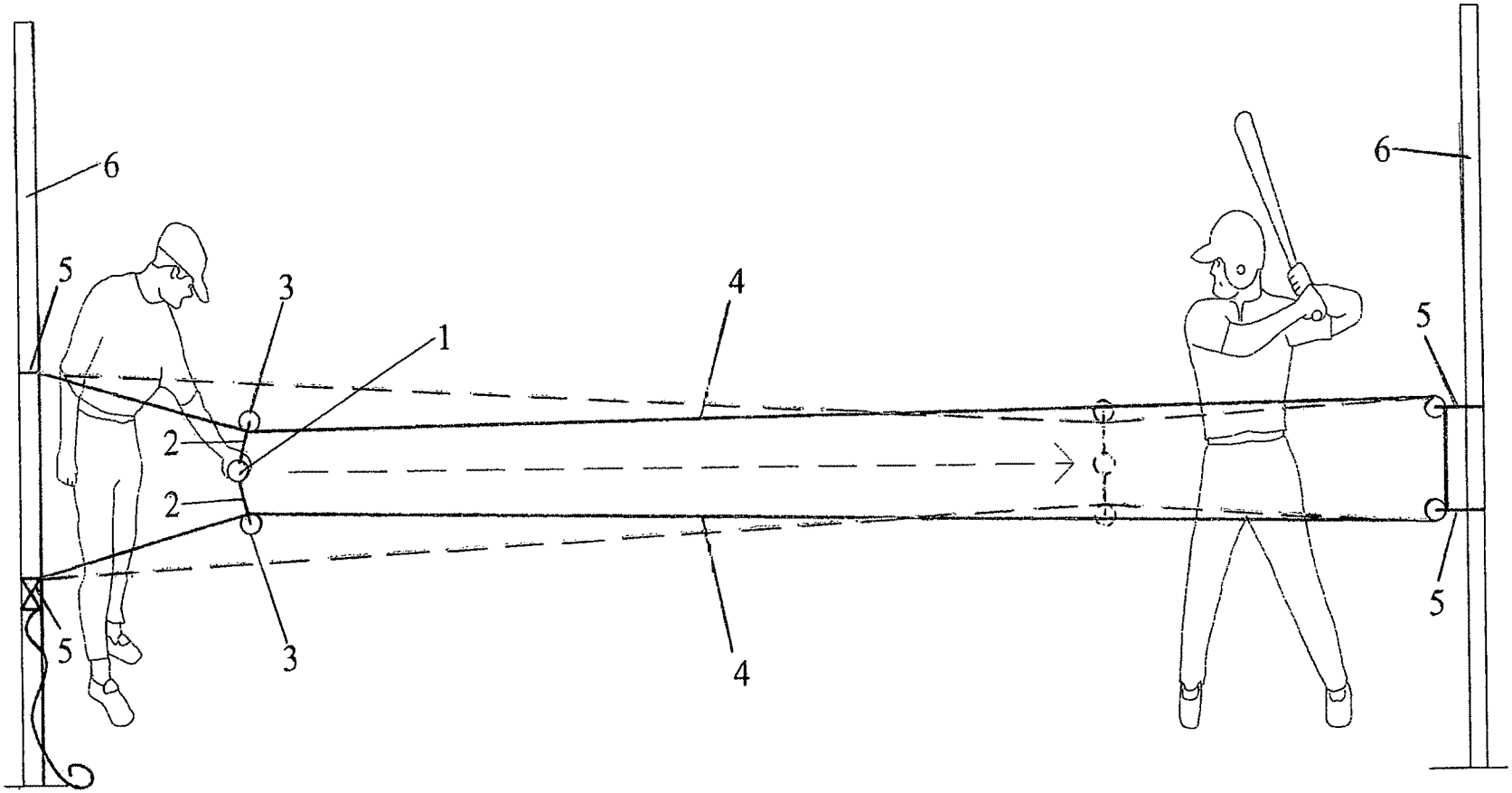
FIG. 2 is a side elevation of the swing training apparatus showing a second person positioned toward one end of the elongate cords and a batter positioned toward the opposite end of the cords, it also shows the spacing between the upper and lower elongate cords to be greater at the end nearest the second person than the spacing between the upper and lower cords at the batter end.

FIG. 2 shows a second person positioned toward one end of the device and a batter positioned toward the opposite end of the cords. It also shows the vertical spacing between the upper and lower elastic cords 4 to be greater at the end nearest the second person than the spacing between the upper and lower cords at the batter end. In use, the second person retracts the ball trolley toward the end opposite the batter and then releases it allowing the ball to travel to the batter where it can be hit with a swing of the bat between the two cords, as shown in dashed lines. Retrieval of the ball after it is hit would be accomplished simply by the second person squeezing the cords together at one end or the batter pulling the cords apart at the other end, or both.

As shown in FIG. 2, the invention anticipates the upper and lower cord as one continuous line, pulleys being used as connection points 5, as shown at the batter end of the cords, and the single cord being pulled taut and tied, as shown at connection point 5 of the lower cord at the end nearest the second person. This configuration of the device allows it to be adapted to varying distances between fixed vertical uprights 6.

A number of different mechanical devices may be employed to vary the spacing between the cords at either end to cause the ball trolley to move toward one end or the other upon activation of the mechanical device. Also, a movable or portable vertical upright 6, held in place by the second person, may be employed to allow the apparatus to be used with a single fixed vertical upright post, fence or other such rigid structure.

Figure 3:
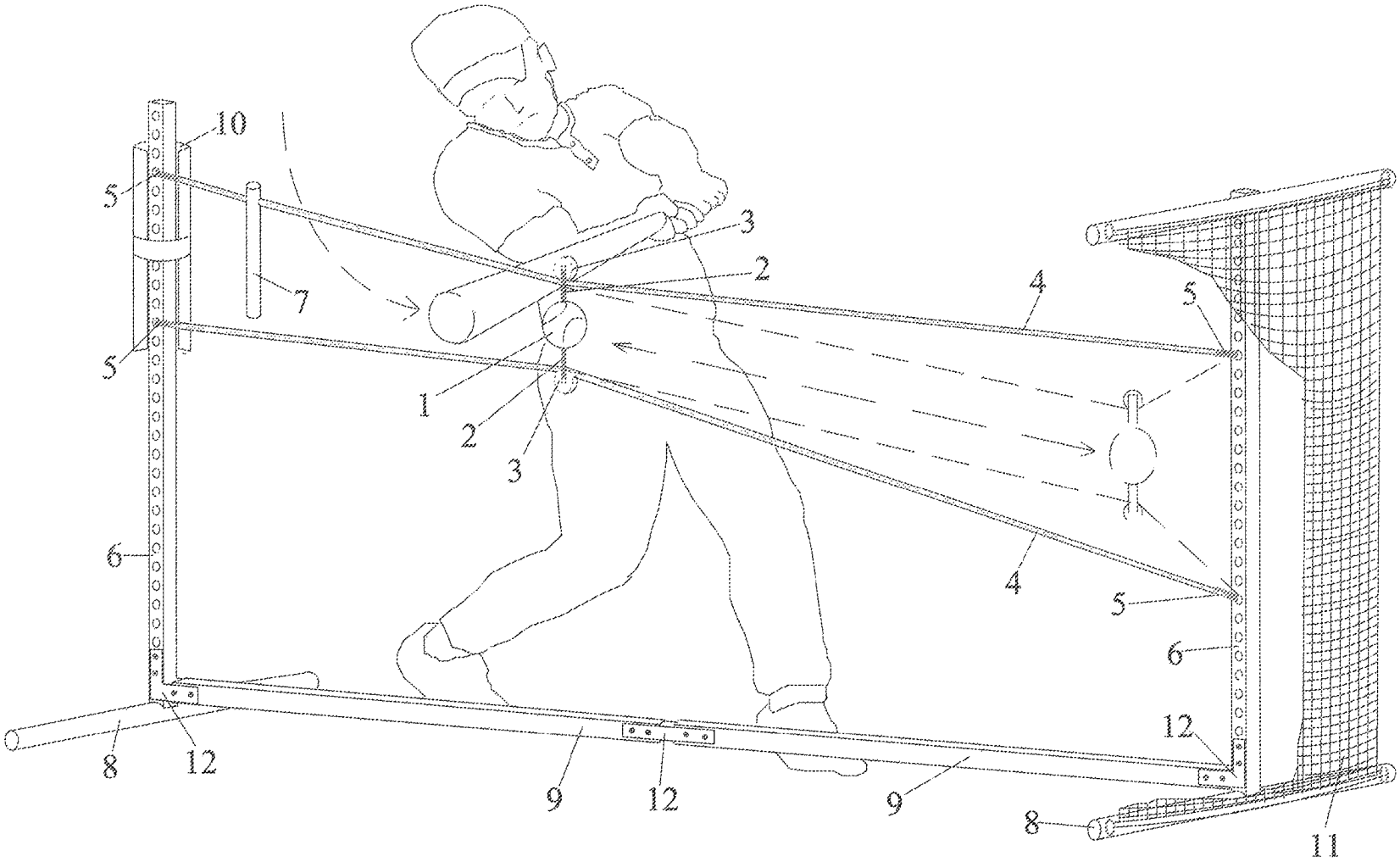
FIG. 3 is a side elevation of the swing training apparatus showing a self-contained embodiment of the invention using a rigid frame with base supports, a cross member support, and uprights, where each upright has a plurality of attachment points for the elongate cords.

FIG. 3 shows a self-contained embodiment of the invention using a rigid frame with base supports 8, cross member support 9 and uprights 6 where each upright has a plurality of attachment points for the elongate cords. Hooks or catches on the ends of the elongate cords and multiple attachment points up and down the length of the uprights allow quick and simple adjustment for ball height, cord spacing and swing or cord angle. The rigid frame permits the device to be used, indoors or outdoors, without need of fixed vertical uprights making it movable, portable and positional as a self-contained unit.

As shown in FIG. 3, optional safety items may be provided. For example padding 10 may be attached to one or both uprights, either at a location where the bat might strike the upright when the device is being used or along the full length and circumference of the upright(s). Another safety option may be a barrier 11, such as a screen or netting that would attach to at least one end of the frame to catch any loose pieces or cord ends that might break away from the device when in use.

The optional ability to disassemble, fold or collapse the frame for transportation or storage is also contemplated, such as connection points 12 which might allow the frame or parts of the frame to separate, fold-up or both.

Figure 4:
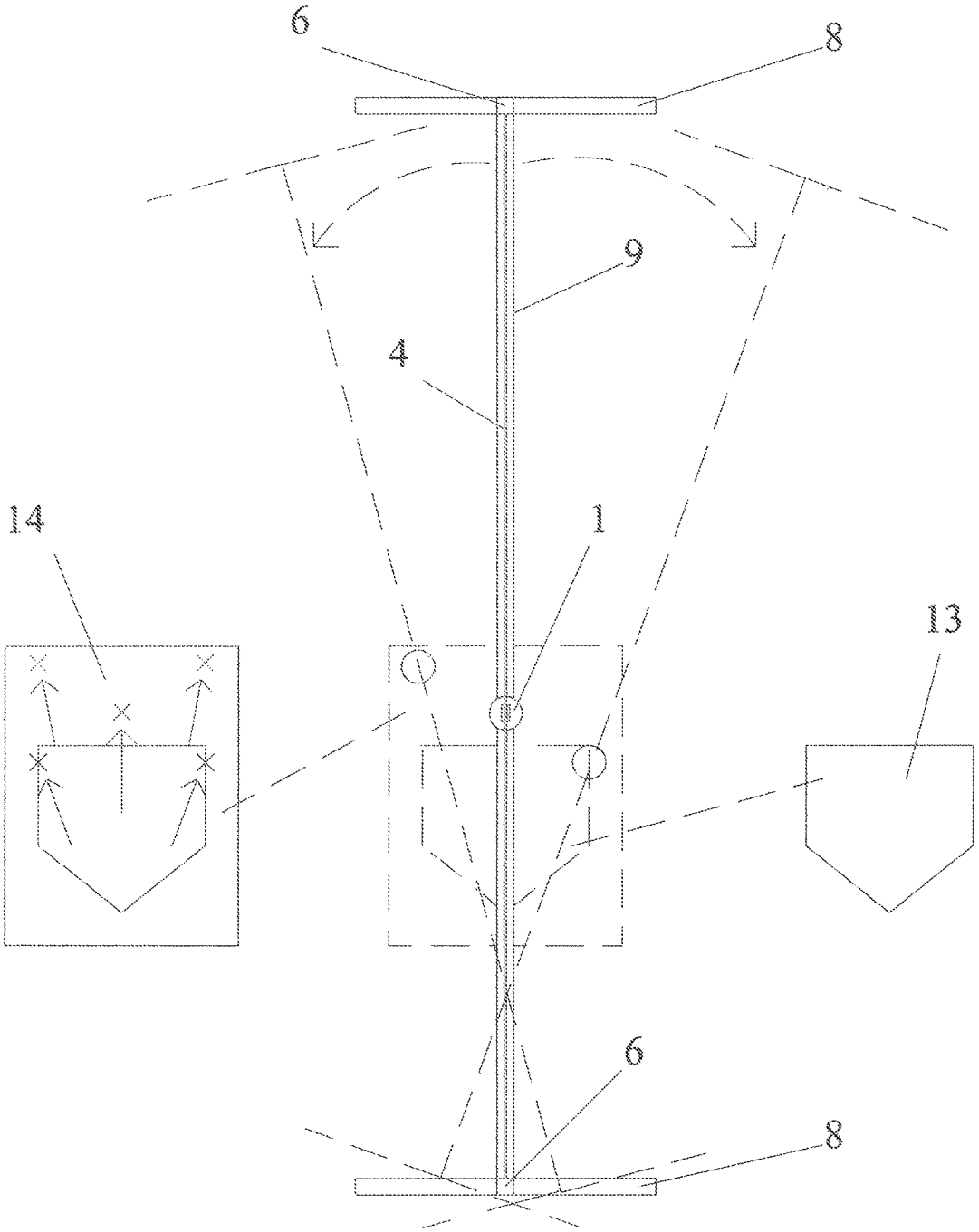
FIG. 4 is a top plan view of the swing training apparatus of FIG. 3 in relation to a baseball home plate anticipating movement of the device and frame to position the ball on the inside, middle or outside of a simulated strike zone. Also shown are an optional throw-down or portable home plate, and a pitch location mat which may be utilized with the invention.

FIG. 4 offers an overhead view of the invention and frame set-up in relation to a baseball home plate anticipating movement of the device and frame to position the ball on the inside, middle or outside of a simulated strike zone. Such adjustments permits a batter to practice hitting the ball toward the near field when the ball is on the inside of the strike zone, toward center field when the ball is in the center of the strike zone and toward the opposite field when the ball is on the outside part of the strike zone. With the frame and device so positioned, the ball trolley acts to re-enforce and provide feedback as to whether the batter's swing and ball strike are correct. Struck squarely toward an upright the ball trolley will travel in that direction and then rebound. Otherwise, the reaction of the ball trolley will be unpredictable, indicating the batter's swing and/or ball contact did not drive the trolley in the prescribed direction.

FIG. 4 also shows two additional optional pieces anticipated by the invention; a throw-down or portable home plate 13 and a pitch location mat 14 with an image of a home plate. Either of these items properly positioned below the ball trolley would condition batters to correctly take their stance in relation to a home plate. The pitch location mat anticipated would also have ball locations and directional indicators showing, for both left and right handed batters, where to make contact and the direction to hit a ball for simulated pitches that are located on the inside, middle and outside of the home plate or strike zone.

Figure 5:
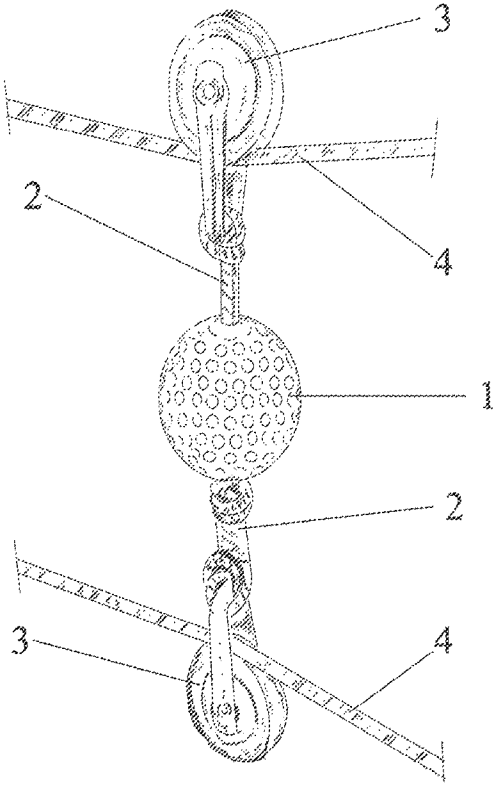
FIG. 5 shows the ball trolley with the practice ball captured between the two pulleys and the trolley supported between the elongate cords.

FIG. 5 shows a ball trolley with a ball 1 captured between two pulleys 3 connected to two elongate cords 4. This embodiment shows a hole axially bored in a practice ball such as a solid polyurethane dimpled pitching machine ball, an inelastic cord 2 tied to the top pulley, the cord extended through the ball, a knot tied below the ball to serve as a stop and the cord tied to the bottom pulley.

Figure 6:
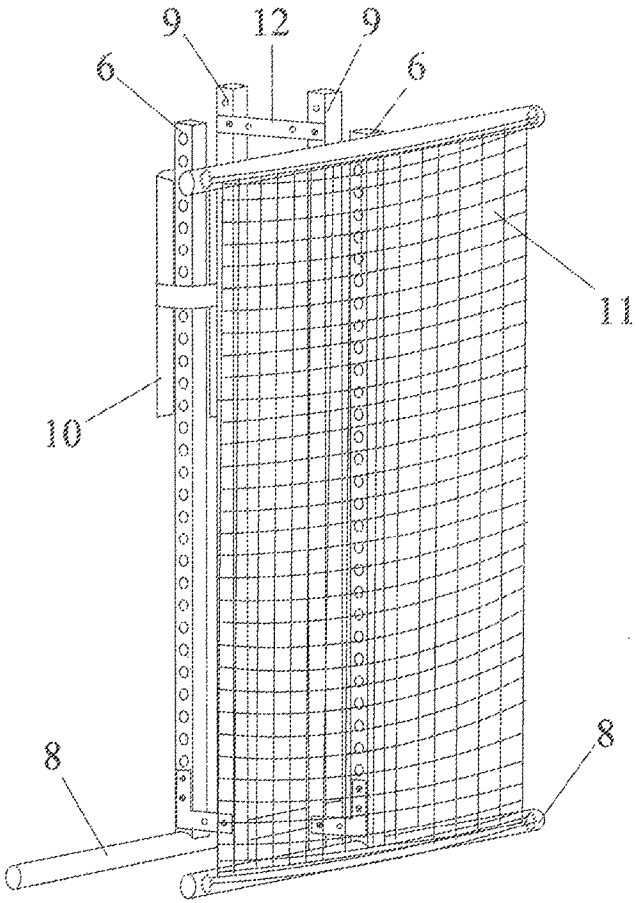
FIG. 6 is a perspective view of the frame of FIG. 3 in a folded or collapsed condition for storage or transport.

FIG. 6 shows a convenience option wherein the frame of FIG. 3 is folded or collapsed for storage or transport.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A ball sports swing practice and training apparatus for suspending or propelling a tethered ball to be hit by a batter, comprising:

two elongated spaced apart cords disposed, one above the other, connected at opposed ends to respective vertical upright members to extend therebetween relative to a horizontal axis in a taut condition, at least one of said elongated cords formed of an elastic material;

a ball trolley including two opposed pulleys connected at opposed ends of an inelastic member of fixed length, said pulleys having grooved sheaves rotatably supported on said spaced apart cords for rolling movement there along, and a practice ball secured on said inelastic member intermediate the opposed pulleys;

the spacing between the respective ends of said elongated cords where connected to said vertical upright members being greater than the fixed length of said inelastic member of said ball trolley such that said ball trolley is tensioned between said elongated cords, and said elongated spaced apart cords are spanned-out and diverge in opposed directions from the point at which said ball trolley pulley sheaves are supported to the points of connection of the respective opposed ends to said vertical upright members.

2. The ball sports swing practice and training apparatus according to claim 1, wherein said elongated spaced apart cords are connected at opposed ends to respective vertical upright members the same distance apart and a distance greater than the fixed length of said inelastic member of said ball trolley such that said ball trolley is tensioned between said elongated cords intermediate the respective opposed ends of said elongated cords to urge said ball trolley to normally reside at an at rest position near the midsection of said elongated cords and thereby allow the batter batting left or right handed, to hit the ball in either direction, after which the ball trolley returns to the at rest position.

3. The ball sports swing practice and training apparatus according to claim 1, wherein said elongated spaced apart cords are connected at opposed ends to respective vertical upright members a different distance vertically apart and a distance greater than the fixed length of said inelastic member of said ball trolley such that said ball trolley is tensioned between said elongated cords intermediate the respective opposed ends of said elongated cords to urge the ball trolley to normally reside at an at rest position near the opposed ends with the lesser spacing and thereby allow the batter standing near the ends with the lesser spacing to hit the ball in the direction of the ends with the greater spacing, after which the ball trolley returns to the at rest position near the ends with the lesser spacing.

4. The ball sports swing practice and training apparatus according to claim 1, wherein said elongated spaced apart cords are connected at opposed ends to said respective vertical upright members a different distance apart and a distance greater than the fixed length of said inelastic member of said ball trolley such that said ball trolley is tensioned between said elongated cords intermediate the respective opposed ends to urge the ball trolley to normally reside at an at rest position near the opposed ends with the lesser vertical spacing; wherein a second person positioned adjacent to the ends with the greater spacing holds the ball and ball trolley and retracts the ball trolley then releases it to travel toward the ends with the lesser spacing and allow the batter standing near the ends with the lesser spacing to hit the ball in the direction of the ends with the greater spacing, after which the ball trolley returns to the at rest position near the ends with the lesser spacing; and retrieval of the ball after it is hit is accomplished by the second person squeezing the greater spaced apart cords together at one end, or the batter pulling the lesser spaced apart cords apart at the ends, or both.

* * * * *